US007901017B1

(12) United States Patent
Kafferlin

(10) Patent No.: US 7,901,017 B1
(45) Date of Patent: Mar. 8, 2011

(54) SECURITY FILE CABINET WITH SELF-CLOSING, SELF-LOCKING DRAWERS

(75) Inventor: Douglas Kafferlin, Spring Creeek, PA (US)

(73) Assignee: Corry Contract, Inc., Corry, PA (US)

( * ) Notice: Subject to any disclaimer, the term of this patent is extended or adjusted under 35 U.S.C. 154(b) by 316 days.

(21) Appl. No.: 11/772,345

(22) Filed: Jul. 2, 2007

(51) Int. Cl.
*E05B 65/46* (2006.01)

(52) U.S. Cl. ..... 312/221; 312/219; 312/319.1

(58) Field of Classification Search ..... 312/216–222, 312/902, 330.1, 333, 215, 257.1, 319.1; 70/DIG. 36
See application file for complete search history.

(56) References Cited

U.S. PATENT DOCUMENTS 686,249 A * 11/1901 Beery ..... 312/319.1
1,006,983 A 10/1911 Schafert
1,241,093 A * 9/1917 Collings ..... 312/319.1
1,309,439 A * 7/1919 Keefer ..... 70/129
2,209,727 A * 7/1940 Gibson ..... 292/36
2,549,545 A * 4/1951 Thibieroz ..... 312/221
2,873,159 A * 2/1959 Becker ..... 312/319.7
3,236,078 A * 2/1966 Eckardt et al. ..... 70/287
3,674,360 A 7/1972 Ratner
3,705,754 A * 12/1972 Drum et al. ..... 312/409
3,767,280 A * 10/1973 McLaughlin ..... 312/219
3,866,993 A * 2/1975 Dean et al. ..... 312/216
4,303,287 A * 12/1981 Taplin ..... 312/215
4,319,793 A * 3/1982 Suttles ..... 312/257.1
4,352,529 A 10/1982 Steinke
4,469,382 A * 9/1984 Slaats et al. ..... 312/219
4,609,233 A * 9/1986 Walla ..... 312/219
4,662,689 A 5/1987 Chatterson et al.
4,721,347 A 1/1988 Kritselis
4,768,844 A * 9/1988 Ludwig ..... 312/221
4,865,404 A * 9/1989 Harper ..... 312/221
4,955,672 A * 9/1990 Pham ..... 312/107.5
5,087,107 A * 2/1992 Fumanelli ..... 312/333
5,158,347 A * 10/1992 Warren et al. ..... 312/319.8
5,356,207 A * 10/1994 Rock et al. ..... 312/334.46
5,364,179 A * 11/1994 Brustle et al. ..... 312/333
5,385,039 A * 1/1995 Feldpausch et al. ..... 70/78
5,427,445 A * 6/1995 Mitchell ..... 312/221

(Continued)

FOREIGN PATENT DOCUMENTS

GB 237501 * 5/1991

*Primary Examiner* — James O Hansen
(74) *Attorney, Agent, or Firm* — Wayne L. Lovercheck

(57) ABSTRACT

A self-closing, self-locking security file cabinet having one or more lateral and vertical file drawers mounted on sliding supports includes a lock return mechanism for returning the lock to the lock position after the individual has released his/her hold on the key with the key staying with the lock when the lock is in the unlock position for opening the drawers, a plurality of lock catches pivotally mounted to vertically slidable lock bars mounted to the interior cabinet side walls adjacent the cabinet front and which interact with fixed protrusions on the exterior surfaces of the drawer side panels to allow the opening of the drawers upon lock rotation and closure of the drawers upon release of the lock by the individual, and a constant rate coil spring having a distal end attached to each drawer for returning an open drawer to the closed position at a controlled rate of acceleration when the drawer is manually released by the individual so that the drawer is not damaged against the cabinet back wall during closure.

12 Claims, 10 Drawing Sheets

U.S. PATENT DOCUMENTS 5,533,798 A * 7/1996 Feldpausch et al. ..... 312/219
5,580,138 A * 12/1996 Grabher ..... 312/319.1
5,685,622 A * 11/1997 Laakso ..... 312/221
5,946,953 A * 9/1999 Feldpausch ..... 70/78
6,347,848 B1 2/2002 Cho
6,402,274 B1 * 6/2002 Reis ..... 312/334.46
6,681,604 B1 * 1/2004 Samsel ..... 70/78
6,848,759 B2 * 2/2005 Doornbos et al. ..... 312/319.1
2004/0104649 A1 6/2004 Muller et al.
2006/0066187 A1 * 3/2006 Chang ..... 312/219
2006/0250055 A1 * 11/2006 Liu ..... 312/218
2006/0267461 A1 * 11/2006 Hoffman ..... 312/219
2009/0026902 A1 * 1/2009 Jurja ..... 312/319.1

* cited by examiner

SECURITY FILE CABINET WITH SELF-CLOSING, SELF-LOCKING DRAWERS

FIELD OF THE INVENTION

The present invention pertains to locking and closing assemblies and mechanisms for lateral and vertical security file cabinets, and more particularly pertains to a security file cabinet having a drawer return mechanism that closes the drawers at a controlled rate and wherein a lock return mechanism returns the lock to the locked position and the key is released by the user.

BACKGROUND OF THE INVENTION

In this era of competition and competitiveness regarding information of any kind, and especially the confidential information of a business, medical, legal, or scientific company or institution, the secure storage of such information is of critical importance to all businesses and institutions. While information is stored electronically and on various types of computer disks and drives, a large bulk of information is still recorded on paper files and documents, and must be securely stored with access controlled thereto. Thus, filing and storage cabinets are the primary storage device for all manner of hard copy records, files, and documents, and a wide range of locking, closing, latching and access devices and mechanisms have been used to safely store such vital items and control access to these items.

For example, representative references in the prior art that disclose drawer cabinets that include self-closing drawers in which the drawers are provided with a spring mechanism for biasing the drawer to a closed position upon release include: the Becker Patent (U.S. Pat. No. 2,873,159), the Rock Patent (U.S. Pat. No. 5,207,781), the Lam et al. Patent (U.S. Pat. No. 6,953,233), the Wiklund et al. Patent (U.S. Pat. No. 7,077,488), and the Lee Patent (U.S. Pat. No. 7,083,243).

The Chen Patent (U.S. Patent Application Publication No. 2006/0261716) discloses a file cabinet system in which the drawer automatically locks when disposed in the closed position, and stays in that state until the locking device is released. Other Patents that disclose this type of assembly include: the Schaffert Patent (U.S. Pat. No. 1,006,983), the Wolters Patent (1,700,299), the Ratner Patent (U.S. Pat. No. 3,674,360), the Chovance et al. Patent (U.S. Pat. No. 3,774,985), the Steinke Patent (U.S. Pat. No. 4,352,529), the McKernan et al. Patent (4,606,266), the Kritselis Patent (U.S. Pat. No. 4,721,347), and the Cho Patent (6,347,848).

References that disclose locks in general that require the lock to be in the locked position before the key can be removed from the lock include: the Schribner Patent (U.S. Pat. No. 851,900), the Diehl Patent (U.S. Pat. No. 973,920), the Lapidus Patent (U.S. Pat. No. 1,076,587), the Sedlacsek Patent (U.S. Pat. No. 1,154,271), the Wyckoff Patent (U.S. Pat. No. 1,239,244), and the Swanson Patent (U.S. Pat. No. 2,469,018).

References that disclose the general state of the art of locking mechanisms and assemblies include: the Heotes Patent (U.S. Pat. No. 1,450,974), the Miller et al. Patent (U.S. Pat. No. 2,105,983), the Chatterson et al. Patent (U.S. Pat. No. 4,662,689), and the Lambert Patent (U.S. Pat. No. 5,723,850).

Nonetheless, despite the wide-ranging ingenuity of the above mechanisms, assemblies, and devices in the security file, cabinet, and drawer fields, there remains a need for a security file cabinet assembly that includes the capability of returning the lock to the locked position when the key is released by the user and a constant rate return mechanism that returns the drawer to the closed position within the cabinet upon release of the drawer.

SUMMARY OF THE INVENTION

The present invention comprehends a security file cabinet having at least one self-closing and self-locking drawer and a return mechanism for returning the drawer to the closed position at a constant rate after the drawer has been released by the user.

The security file drawer includes a security file cabinet having at least one, and generally, two or more slidable and lockable cabinet drawers. The security file cabinet includes a top wall, a bottom panel, opposed sidewalls, a back wall, and an upper front panel strip, and is also defined by having a front and a back or rear. Mounted to the inside surfaces of the sidewalls are guide rails that support and guide the slidable movement of the cabinet drawers during their opening and closing. In addition, a channel is centrally mounted to the back wall and vertically extends therealong from the bottom panel to the top wall. A lock assembly is mounted to the upper front panel strip so that the individual can insert a key in the lock and rotate the lock clockwise for opening the file drawer. A spring return mechanism automatically returns the lock of the lock assembly to the locked position immediately upon the individual manually releasing his or her grasp on the key.

Mounted to each inside surface of each sidewall, and adjacent to the front of the file cabinet, is a lock bar. The lock bars are further denoted as the left hand lock bar and the right hand lock bar relative to the individual situated directly in front of the security file cabinet, and the lock bars are slidably movable up and down consonant with the rotation of the lock as part of the process of opening (unlocking) and closing (locking) the cabinet drawer(s). Each lock bar is attached at its respective upper end to the lock assembly by an intermediate linkage bar that extends along the inside of the upper front panel strip. Inserting the key in the lock assembly and turning the key causes the lock to rotate, and this rotation is conveyed by a lock cam to the intermediate linkage bars, which, in turn, is transmitted to the lock bars as linear motion thereby actuating the up and down movement of the lock bars for unlocking and locking the cabinet drawers. It should be noted that during the process of both unlocking and locking the cabinet drawers, the vertical movement of the left hand lock bar is in the opposite direction as the vertical movement of the right hand lock bar.

Each file drawer for the security file cabinet includes a drawer front panel, opposed drawer side panels, a drawer back panel, and a drawer underside or bottom panel. Mounted on the exterior sides of the side panels of each drawer is a protrusion, and the protrusions are positioned so that they interact with lock catches that are pivotally mounted to the lock bars for allowing the drawers to be opened when the lock is turned to the unlock position, and for preventing the drawers from being pulled open after the drawers have been released, have passed by the lock catches, and returned to the closed position. A security file cabinet having two lateral sliding security file drawers will have four pivotally mounted lock catches, more specifically denoted an upper and a lower lock catch pivotally mounted to the left hand lock bar and an upper and lower lock catch pivotally mounted to the right hand lock bar. The pivotal movement of the lock catches occurs when the drawers are released so that as the drawers close the protrusions contact and pivot the lock catches out of the way thereby permitting the drawers to return to the fully closed and locked position.

The security file cabinet of the present invention also includes a return mechanism that returns the drawers to the closed position at a constant and controlled speed to avoid the drawers banging against the back wall of the security file cabinet upon their release by the individual. The return mechanism can be adapted for one or more drawers, and if the security file cabinet contains, for example, two drawers, each drawer has its own automatic return mechanism that operates independently of the return mechanism for the other drawer. The return mechanism includes a coil spring mounted to the back channel by an axle and bracket. The distal end of the coil spring, sized to control the rate of acceleration, is attached to the drawer underside, and when the drawer is unlocked and then pulled out the coil spring is unwound or paid out with the opening of the drawer. As soon as the individual releases the key so that the lock return mechanism returns the lock to the locked position, and then releases his/her hold on the drawer, the coil spring instantly actuates to slowly wind at a controlled rate of acceleration and return the drawer, concomitant with the winding of the coil spring, to the closed position within the security file cabinet.

The lock return mechanism, the pivotally mounted lock catches, and the controlled rate of acceleration coil spring can also be adapted to function with a no key lock assembly that may consist of access code buttons and a rotatably mounted lock engagement button that is rotated for unlocking the drawer after the correct access code has been entered via the access code buttons. Other types of no key or keyless lock assemblies that can be incorporated into the system of the present invention can include electronic locks (combination, proximity, or remote access), biometric locks and RFID-based locks.

It is an object of the present invention to provide a self-closing, self-locking security file drawer that includes a return mechanism centrally mounted to the inside back wall surface of the cabinet for returning the drawer to the closed position at a controlled rate of acceleration upon the drawer being released by the user.

It is another object of the present invention to provide a self-closing, self-locking security file drawer wherein the return mechanism is a constant force return spring with one end attached to the underside of the drawer.

It is a further object of the present invention to provide a self-closing, self-locking security file drawer wherein the key can only be removed from the lock when the lock is in the locked position so that the key stays with the lock when in the unlocked position.

It is yet another object of the present invention to provide a self-closing, self-locking security file drawer wherein the controlled rate of acceleration return mechanism can be integrated with no key lock assemblies.

It is yet a further object of the present invention to provide a self-closing, self-locking security file drawer that includes a lock assembly that is spring biased for automatically returning the lock of the lock assembly to the locked position upon release of the key by the user.

It is still yet another object of the present invention to provide a self-closing, self-locking security file drawer wherein the spring biased return mechanism for the lock of the lock assembly is accomplished by an extension spring.

These and other objects, features, and advantages will become apparent to those skilled in the art upon a perusal of the following detailed description read in conjunction with the accompanying drawing figures and appended claims.

DETAILED DESCRIPTION OF THE PREFERRED EMBODIMENT

Illustrated in FIGS. 1 through 14*b* is a self-closing, self-locking security file cabinet 10 that incorporates such features as a non-removable key when the lock is in the unlocked position, a lock return mechanism for returning the lock to the locked position by itself and without user assistance, and a drawer return mechanism that automatically returns the drawer to the closed position upon release of the drawer with a constant speed so that the drawer isn't damaged or bangs against the back wall of cabinet 10.

Security file cabinet 10 of the present invention can include various makes, models, and designs of vertical or lateral file cabinets, and can further include lock assemblies such as a key lock, a combination lock or an electronic lock (combination, proximity, or remote access), as well as various no key lock assemblies.

Figure 1:
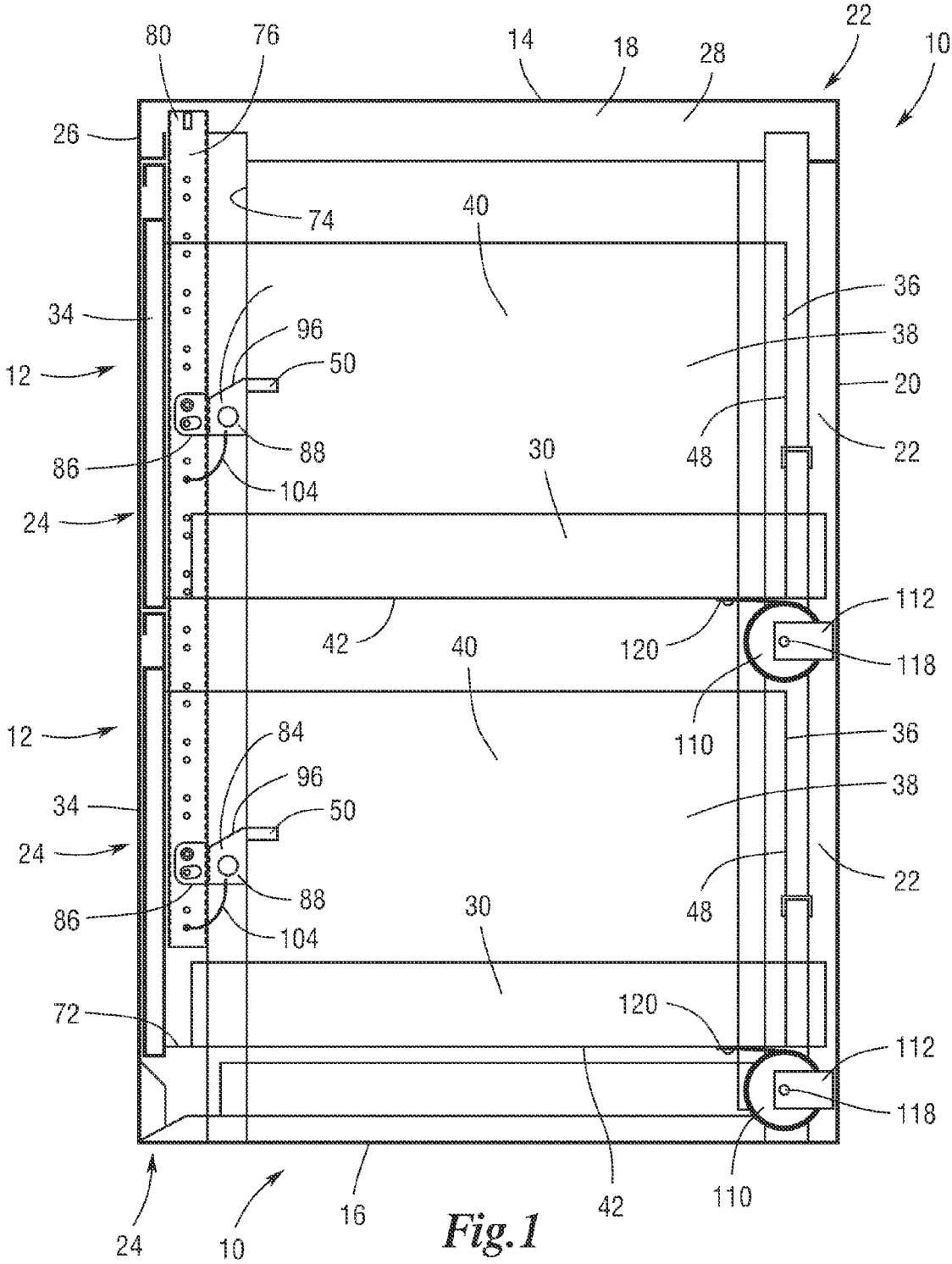
FIG. 1 is a side elevational view of the self-closing, self-locking security file cabinet of the present invention showing the disposition of the constant force return springs and the lock catches for the drawers of a lateral file cabinet when the drawers are in the closed and locked disposition.
Figure 2:
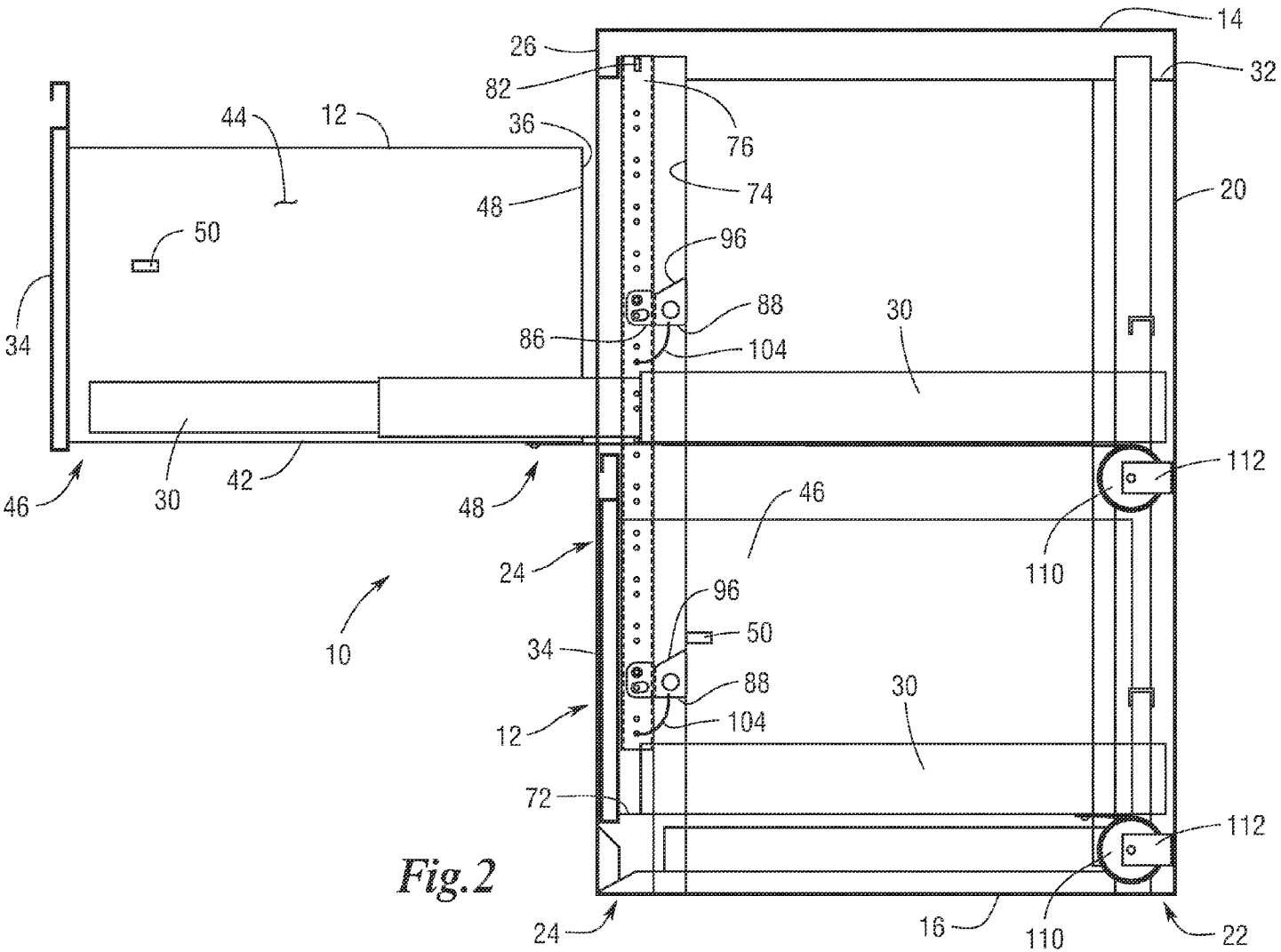
FIG. 2 is a side elevational view of the self-closing, self-locking security file cabinet of the present invention showing the unwound disposition of the upper constant force return spring when the upper cabinet drawer is fully opened.
Figure 3:
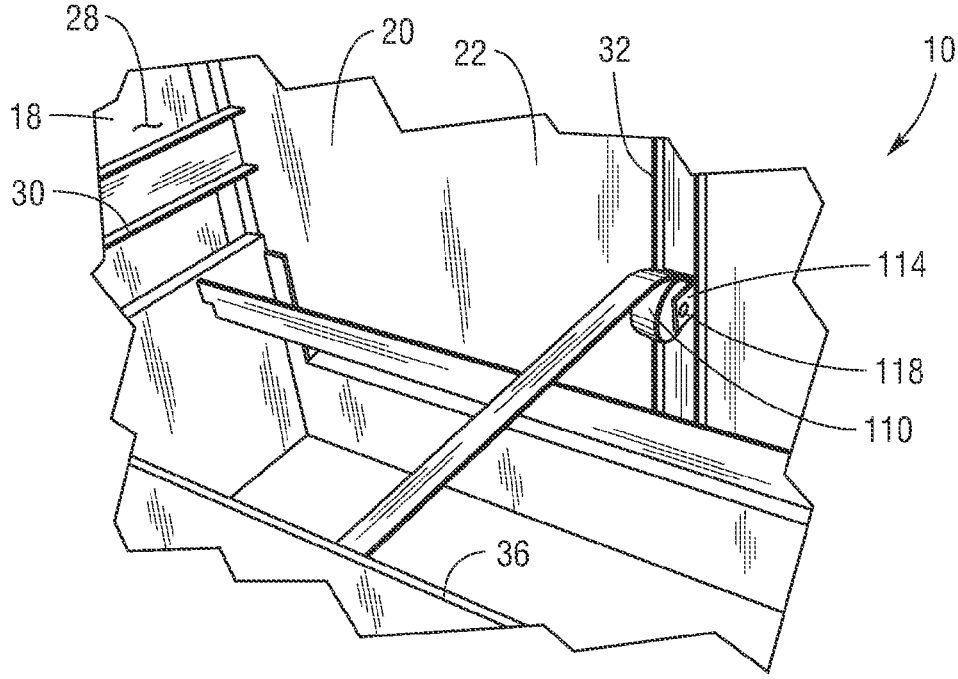
FIG. 3 is a perspective view of the self-closing, self-locking security file cabinet of the present invention illustrating the mounting of the constant force return spring to a channel centrally mounted to the inside surface of the back wall of the cabinet with the return spring unwound concomitant with the opening of the drawer.
Figure 4:
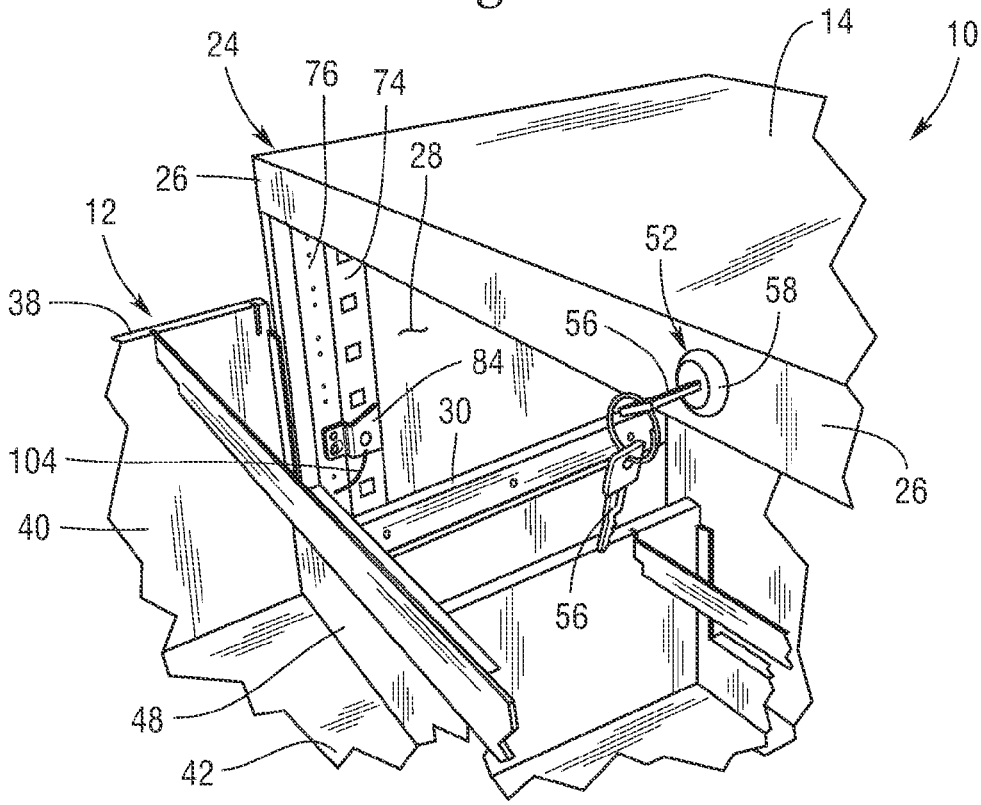
FIG. 4 is a perspective view of the self-closing, self-locking security file cabinet of the present invention illustrating the rotation of the key in the lock for permitting the opening of the upper drawer of the file cabinet.
Figure 5:
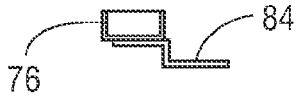
FIG. 5 is a top plan view of the self-closing, self-locking security file cabinet of the present invention illustrating the orientation of one lock catch mounted to the lock bar designated the left hand lock bar.
Figure 7:
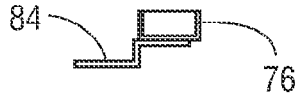
FIG. 7 is a top plan view of the self-closing, self-locking security file cabinet of the present invention illustrating the orientation of one lock catch mounted to the lock bar denoted the right hand lock bar.

Thus, shown in FIGS. 1 through 4, and 9 through 12*b*, for representative purposes, is lateral security file cabinet 10 having a plurality of drawers 12 (two for the representative cabinet 10), with drawers 12 arranged one above the other, and which selectively open and close with a slidable lateral motion, and whose access is controlled by a standard key and modified lock assembly. Security file cabinet 10 includes a top wall 14, an opposite bottom or floor panel 16, opposed sidewalls 18, and a back wall 20. Security file cabinet 10 is further defined by having a rear or back area 22 adjacent the back wall 20 and a front area 24 at which drawers 12 open and close. As shown in FIGS. 3 and 4, security file cabinet 10 includes an upper front panel strip 26 that horizontally extends across front 24 of cabinet 10 and is adjoined to sidewalls 18.

In addition, each sidewall 18 includes an inside or interior surface 28, and attached to each inside surface 28 is a sliding support or guide rail 30 for supporting and guiding the drawers 12 in their lateral movement during opening and closing. Two guide rails 30 are used for each drawer 12, and thus for representative security file cabinet 10 of the present invention, there are two guide rails 30 for each drawer 12—one guide rail 30 is mounted to each opposed inside surface 28 of each sidewall 18 for each drawer 12. Sliding supports 30 can be of any conventional type or construction such as ball bearing, telescoping or roller. Mounting drawers 12 within cabinet 10 on such sliding supports 30 allows drawers 12 to be moved back and forth from their open to their closed position, as shown in FIG. 2, with the application of relatively little force. As shown in FIGS. 3, 4, 9, 12*a*, and 12*b*, a channel 32 is centrally mounted to back wall 20 of cabinet 10 and extends from floor panel 16 to top wall 14.

Illustrated in FIGS. 1 through 4 and 11*a* through 12*b* are drawers 12, drawers 12 are identical in construction, and each drawer 12 includes a drawer front panel 34, a drawer back panel 36, and opposed drawer side panels 38 with the aforementioned elements forming a drawer cavity or body 40 for the placement and storage therein of files, papers, documents, etc. Each drawer 12 also includes an underside panel 42 and each side panel 38 is further defined by having an exterior side surface 44. Each drawer 12 includes a drawer front 46 that is the area or portion adjacent drawer front panel 34 and a drawer rear or back 48 that is the area or portion adjacent drawer back panel 36. In addition, fixedly mounted to exterior side surface 44 of each side panel 38 of each drawer 12 is a protrusion or projection 50. Protrusions 50 are mounted to the adjacent front 46 of each drawer 12 and cooperate with elements hereinafter described to facilitate the opening and closing of drawers 12.

Illustrated in FIGS. 4, 10*a*, 10*b*, 12*a*, and 12*b* is a key and lock assembly 52 for controlling access to the contents stored within drawers 12 so that only authorized personal personnel or employees can have access to the documents stored therein. Lock assembly 52 includes a slot 54 for insertion of an appropriate key 56, a lock 58 that is rotatable clockwise, within the range of 90 degrees, upon insertion of key 56 and then rotation of key 56 in the desired direction, and a lock cam 60 interconnected to lock 58 but which is not visible to the user when situated in front 24 of security file cabinet 10. The rotation of key 56 actuates the rotation of lock 58, and the rotation of lock cam 60 occurs concomitant with the rotation of lock 58. A pair of intermediate link bars 62 are pivotally adjoined to lock cam 60 with one intermediate link bar 62 adjoined to lock cam 60 and horizontally extending across front 24 of cabinet 10 immediately behind upper front panel strip 26 to sidewall 18 denoted the left hand sidewall (relative to the user standing in front of cabinet 10); and one intermediate link bar 62 extending across front 24 of cabinet 10 immediately behind upper front panel strip 26 to sidewall 18 denoted the right hand sidewall (also relative to the user situated directly in front of cabinet 10). Nylon lock nuts 64 attach inner ends 66 of intermediate link bars 62 to the rear of lock 58 via linkage members 68 positioned immediately adjacent lock cam 60 and that are part of key and lock assembly 52. Attachment of inner ends 66 of intermediate link bars 62 to lock cam 60 through linkage members 68 allows the intermediate link bars 62 to freely pivot at these jointures as a result of the rotation of lock cam 60 when lock 58 is rotated for opening and closing drawers 12. Each intermediate link bar 62 also includes a distal link bar end 70 that extend adjacent to opposed sidewalls 18 of cabinet 10.

Illustrated in FIGS. 1 through 8, 12*a*, and 12*b* are a pair of elongated lock channels 72 that are integrally formed on inside surfaces 28 of each sidewall 18 adjacent front 24 of cabinet 10. Lock channels 72 extend therealong from top wall 14 to bottom floor panel 16. Disposed alongside and parallel to each lock channel is a lock guide 74 with each lock guide 74 being coextensive in length with the respective lock channel 72. Disposed within each lock channel 72 for selective slidable up and down movement is a lock bar 76 with the slidable up and down movement of lock bars 76 occurring in lock channels 72 and being constrained by adjacent lock guides 74. The slidable movement of lock bars 76 results and is actuated by key and lock rotation and the engagement of lock cam 60 with inner ends 66 of intermediate link bars 62. Lock bars 76 are further defined as a left hand lock bar and a right hand lock bar, and each lock bar 76 includes a lower lock bar end 78 and an upper lock bar end 80. Located at upper end 80 of each lock bar 76 is a linkage slot 82 so that distal end 70 of each intermediate link bar 62 can be inserted into and through respective linkage slot 82.

Illustrated in FIGS. 1 through 8 and 11*a* through 12*b* are a plurality of spring-loaded lock catches 84 that are pivotally mounted to lock bars 76. Lock catches 84 cooperate with protrusions 50 to allow protrusions 50 to pass by lock catches 84 during the process of opening and closing drawers 12. The lock catches lift on one side and lower on the other side to let drawers 12 pass when opening, and after the lock catches all rotate to let drawers 12 close. Specifically, for security file cabinet 10 of the present invention having two drawers 12, four lock catches 84 will be utilized whereby two lock catches 84 are pivotally mounted to lock bar 76 denoted the left-hand lock bar with one lock catch 84 coacting with drawer 12 denoted the upper drawer and one lock catch 84 coacting with drawer 12 denoted the lower drawer. Two lock catches 84 are pivotally mounted to lock bar 76 denoted the right-hand lock bar with one lock catch 84 coacting with drawer 12 denoted the upper drawer and one lock catch 84 coacting with drawer 12 denoted the lower drawer.

Figure 6:
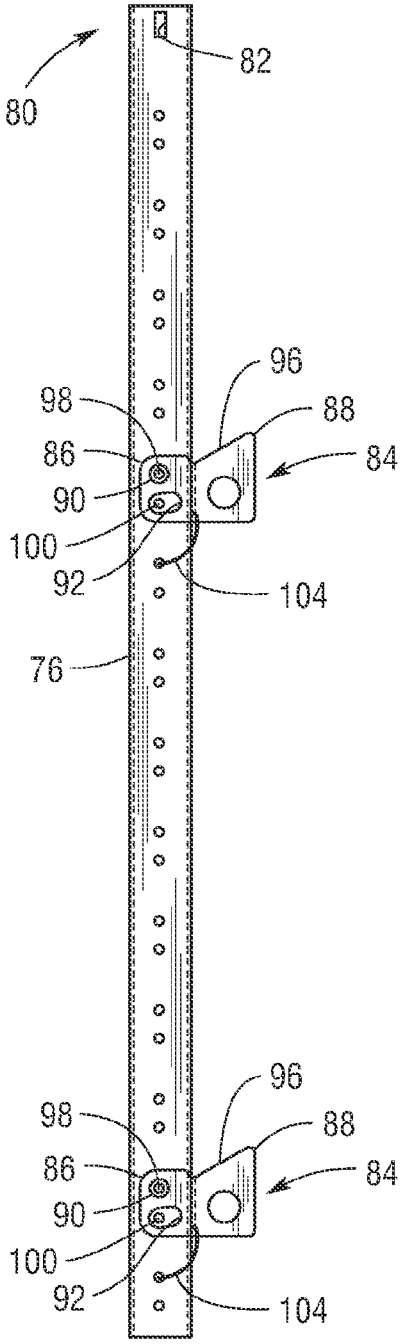
FIG. 6 is a side elevational view of the self-closing, self-locking security file cabinet of the present invention illustrating the pivotal mounting of the lock catches, specifically designated the upper and lower left hand lock catches, to the lock bar denoted the left hand lock bar.
Figure 8:
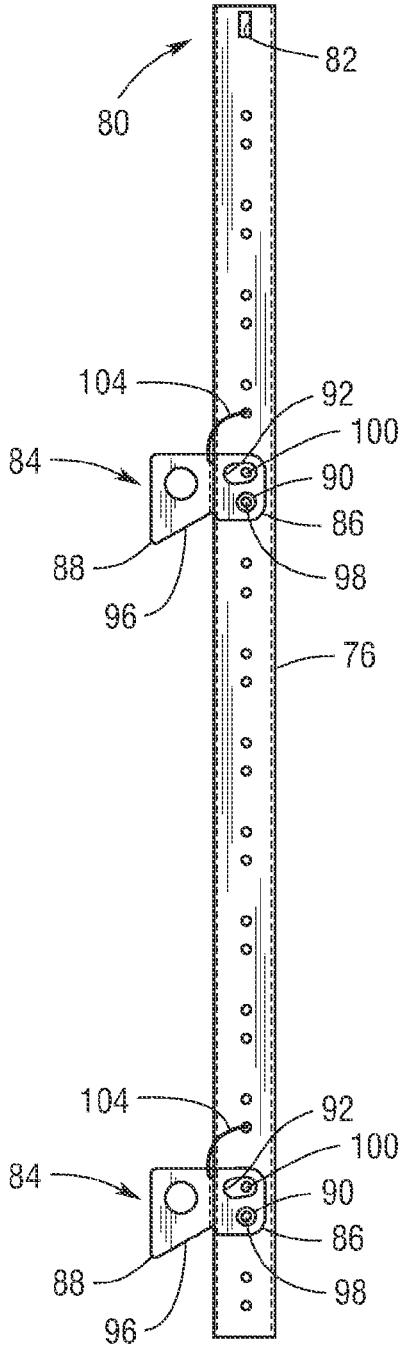
FIG. 8 is a side elevational view of the self-closing, self-locking security file cabinet of the present invention illustrating the pivotal mounting of the lock catches, specifically designated the upper and lower right hand lock catches, to the lock bar denoted the right hand lock bar.
Figure 9:
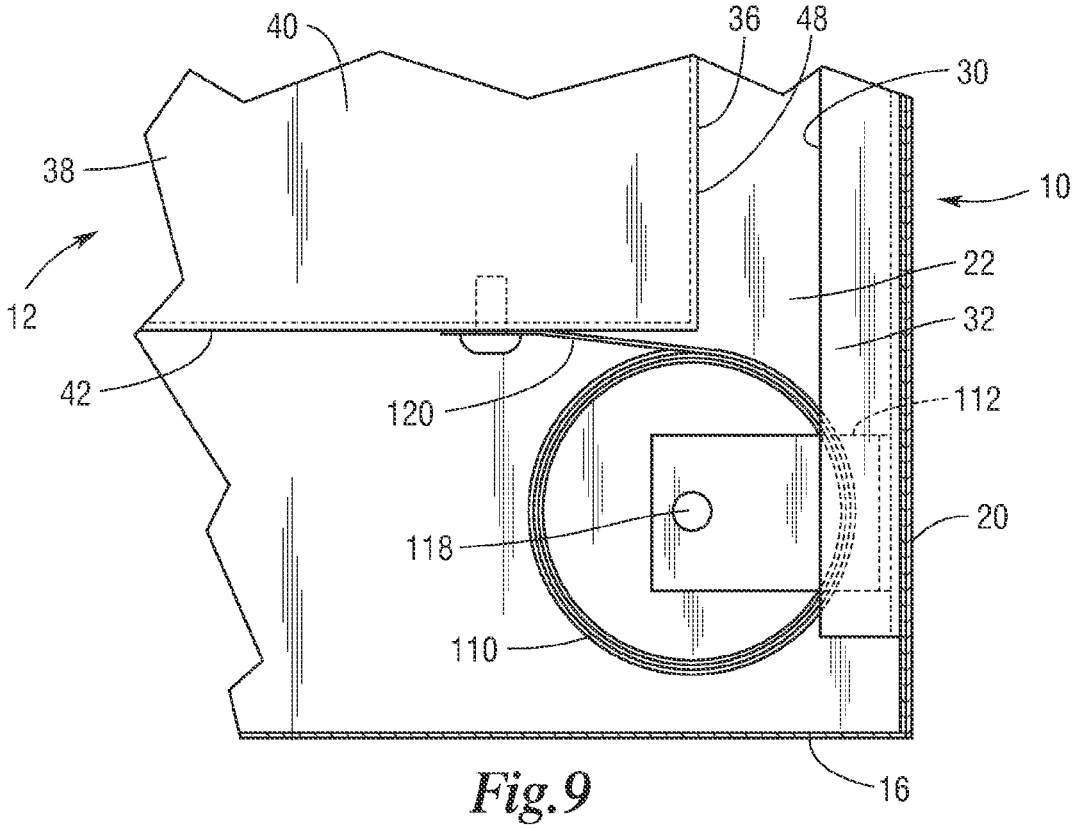
FIG. 9 is a sectioned elevational view of the self-closing, self-locking security file cabinet of the present invention illustrating the securement of the distal end of the constant rate coil spring to the underside of one drawer.
Figure 10A:
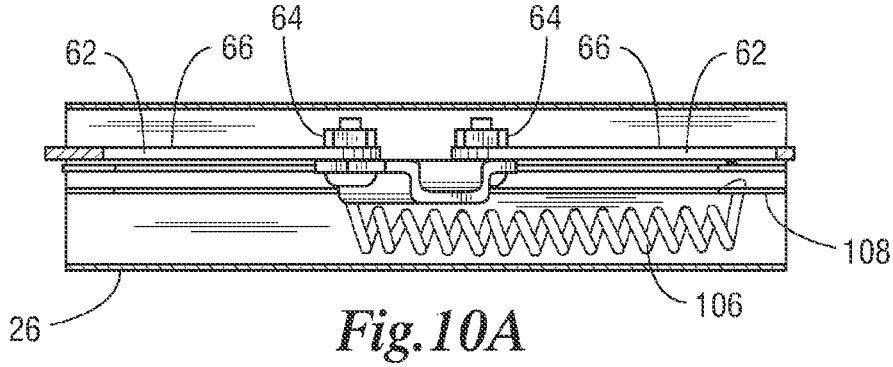
FIG. 10*a* is a partial top plan view of the self-closing, self-locking security file cabinet of the present invention illustrating the lock assembly and the lock return mechanism in the form of an extension spring that automatically returns the lock assembly to the lock position when the key is released.
Figure 10B:
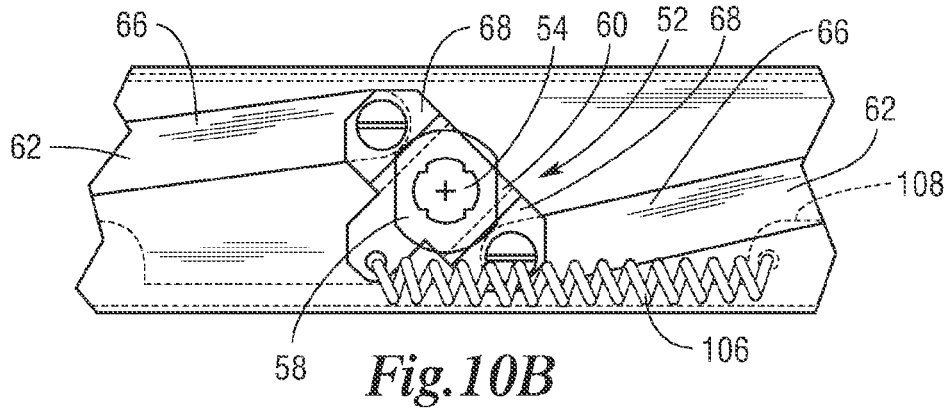
FIG. 10*b* is a partial front elevational view of the self-closing, self-locking security file cabinet of the present invention illustrating the disposition of the lock assembly when the drawer is in the locked disposition.
Figure 11A:
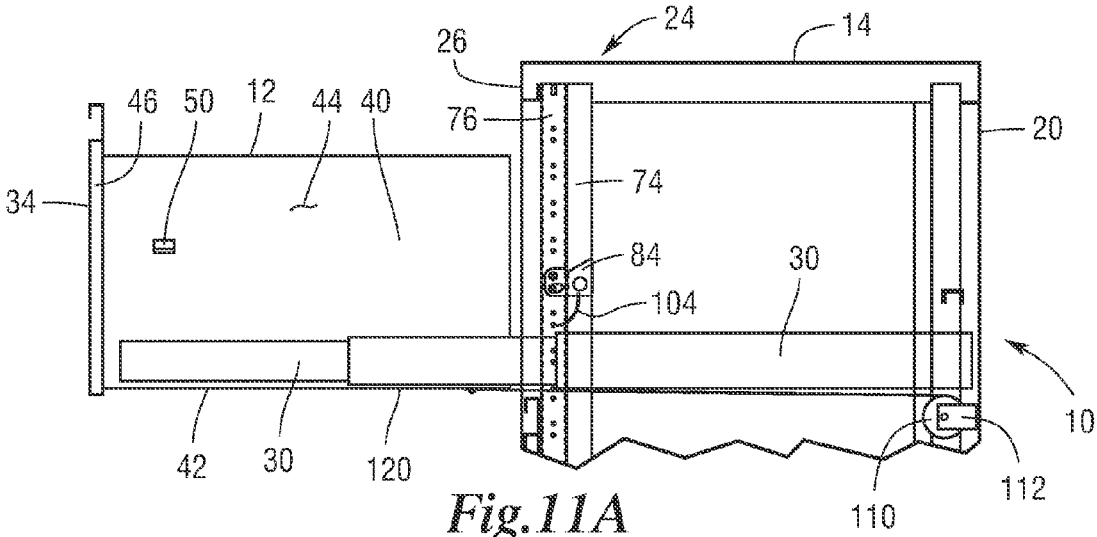
FIG. 11*a* is a partial side elevational view of the self-closing, self-locking security file cabinet of the present invention illustrating the upper drawer fully opened and the constant rate coil spring paid out or unwound as a result of the upper drawer being opened.
Figure 11B:
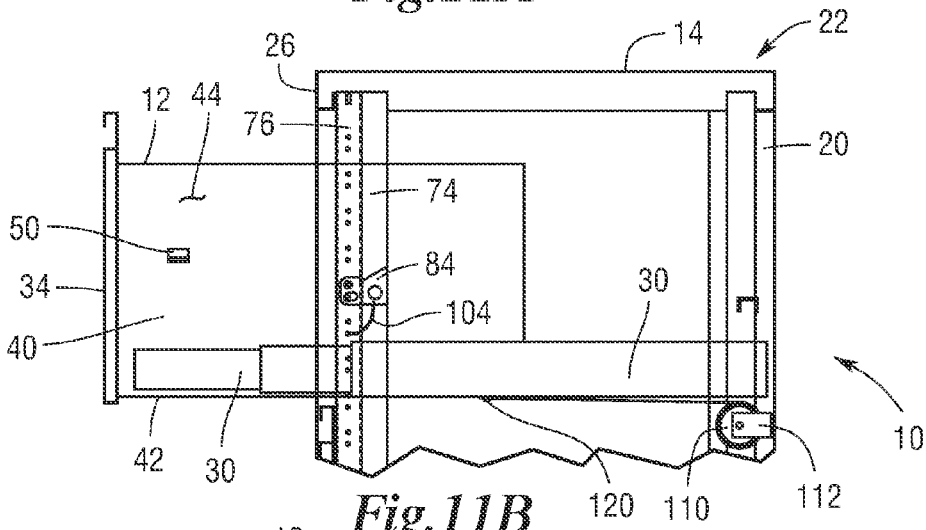
FIG. 11*b* is a partial side elevational view of the self-closing, self-locking security file cabinet of the present invention illustrating the upper drawer in an intermediate position between the opening and closing of the drawer.
Figure 11C:
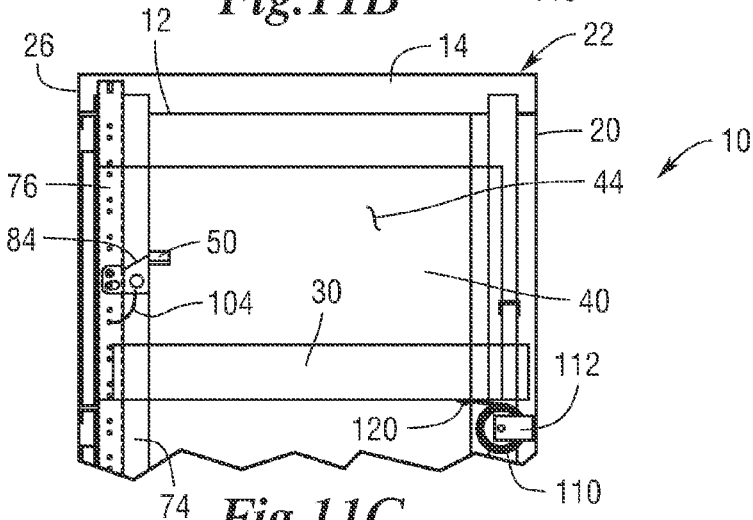
FIG. 11*e* is a partial side elevational view of the self-closing, self-locking security file cabinet of the present invention illustrating the upper drawer of the file cabinet in the completely closed and locked disposition and the constant rate coil spring in the fully wound disposition.

As shown in FIGS. 6 and 8, each lock catch 84 is comprised of a mounting portion 86 and a trapezoidal-shaped portion 88. Mounting portion 86 includes a mounting aperture 90 and an, and trapezoidal-shaped portion 88 includes a pivot aperture 94. Trapezoidal-shaped portion 88 of each lock catch 84 includes a beveled side 96 that co-acts with corresponding protrusion 50 on drawer 12 to allow drawer 12 to pass by lock catch 84 as part of the process of closing drawer 12. A mounting pin 98 is inserted through mounting aperture 90 of each lock catch 84 and through the desired opening in lock bar 76 for affixing lock catch 84 to that lock bar 76. A limit pin 100 is mounted to lock bar 76 and projects slightly through oblong aperture 92 for delimiting the range of pivotal motion of lock catch 84 during the opening and closing of drawer 12. Thus, each lock catch 84 pivots upon its respective mounting pin 98, and the range of pivotal motion of each lock catch 84 is delimited by limit pin 100 protruding through oblong aperture 92, the length or size of oblong aperture 92, and the range of up-and-down reciprocable slidable movement of lock bars 76 within lock channels 72.

As shown in FIGS. 1, 2, 4, 6, and 8, the spring loading for returning each lock catch 84 to the lock position (illustrated in FIG. 1), immediately after protrusions 50 have cleared lock catches 84 is accomplished by attaching each lock catch 84 to the corresponding slidable lock bar 76 by a lock catch spring 104 that can be a flexible steel spring. Thus, lock catch springs 104 instantly force lock catches 84 back to the lock position immediately upon protrusions 50 clearing and rearwardly passing by the corresponding lock catches 84 during the process of closing drawers 12.

It should be noted, as shown in FIGS. 6, 8, 12*a*, and 12*b*, that lock catches 84 pivotally mounted to lock bar 76 denoted the left-hand lock bar are disposed below protrusions 50 on drawers 12, and beveled sides 96 for these lock catches 84 face upper end 80 of this lock bar 76; while lock catches 84 that are pivotally mounted to lock bar 76 denoted the right-hand lock bar are disposed above the corresponding protrusions 50 on drawers 12 and their beveled sides 96 face downwardly toward lower end 78 of this lock bar 76. Moreover, lock catch springs 104 for lock catches 84 on lock bar 76 denoted the left-hand lock bar exert an upwardly directed force to return these lock catches 84 to the locked position while lock catch springs 104 for lock catches 84 on lock bar 76 denoted the right-hand lock bar exert a downwardly directed force to return these lock catches 84 to the locked position.

Figure 12A:
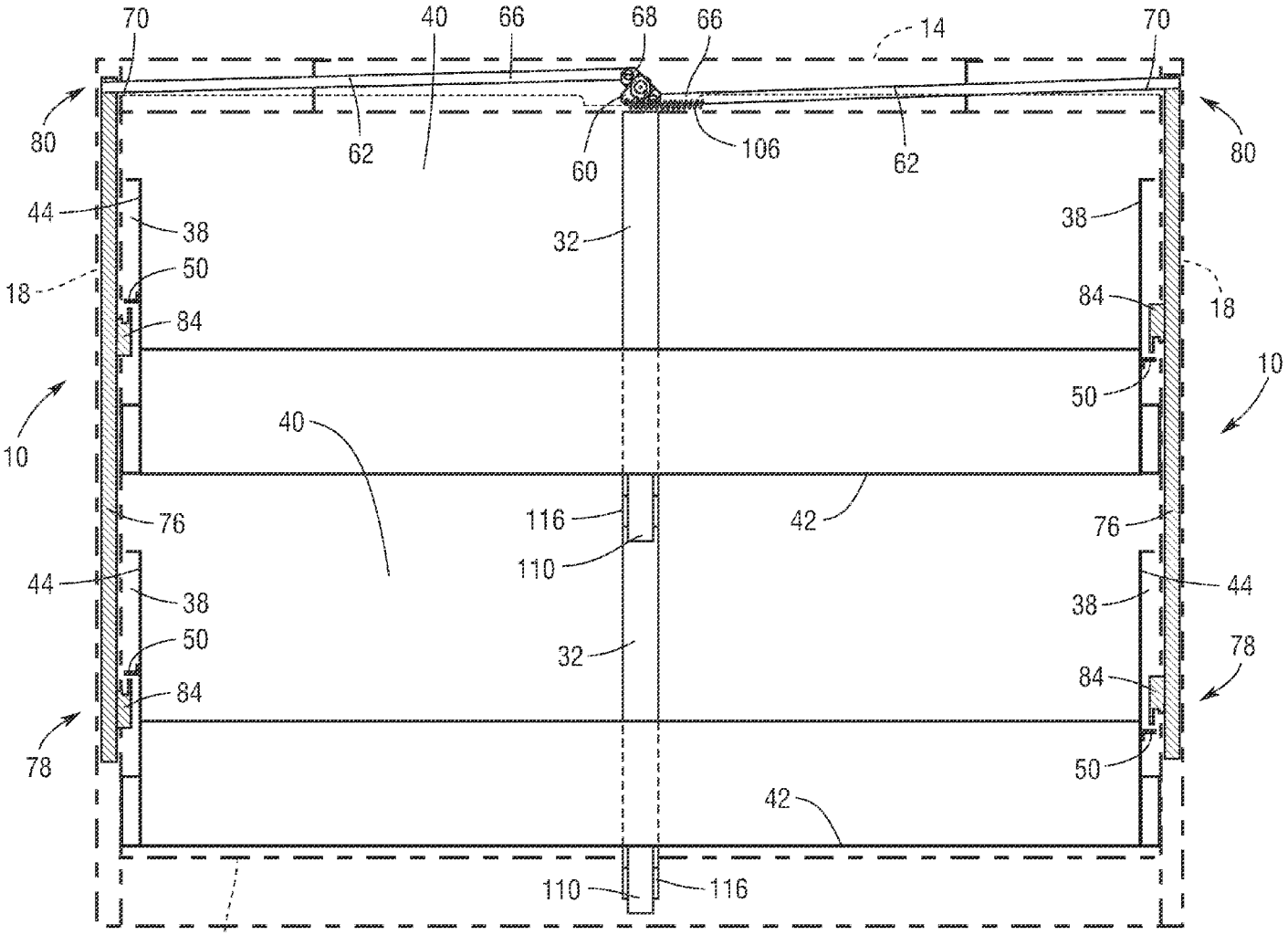
FIG. 12*a* is a front elevational view of the self-closing, self-locking security file cabinet of the present invention illustrating the disposition of the left hand and right hand lock bars and the upper and lower left hand and right hand lock catches relative to the corresponding protrusions on the file drawers after the lock has been rotated to the open position for opening the upper and lower drawers of the cabinet.
Figure 12B:
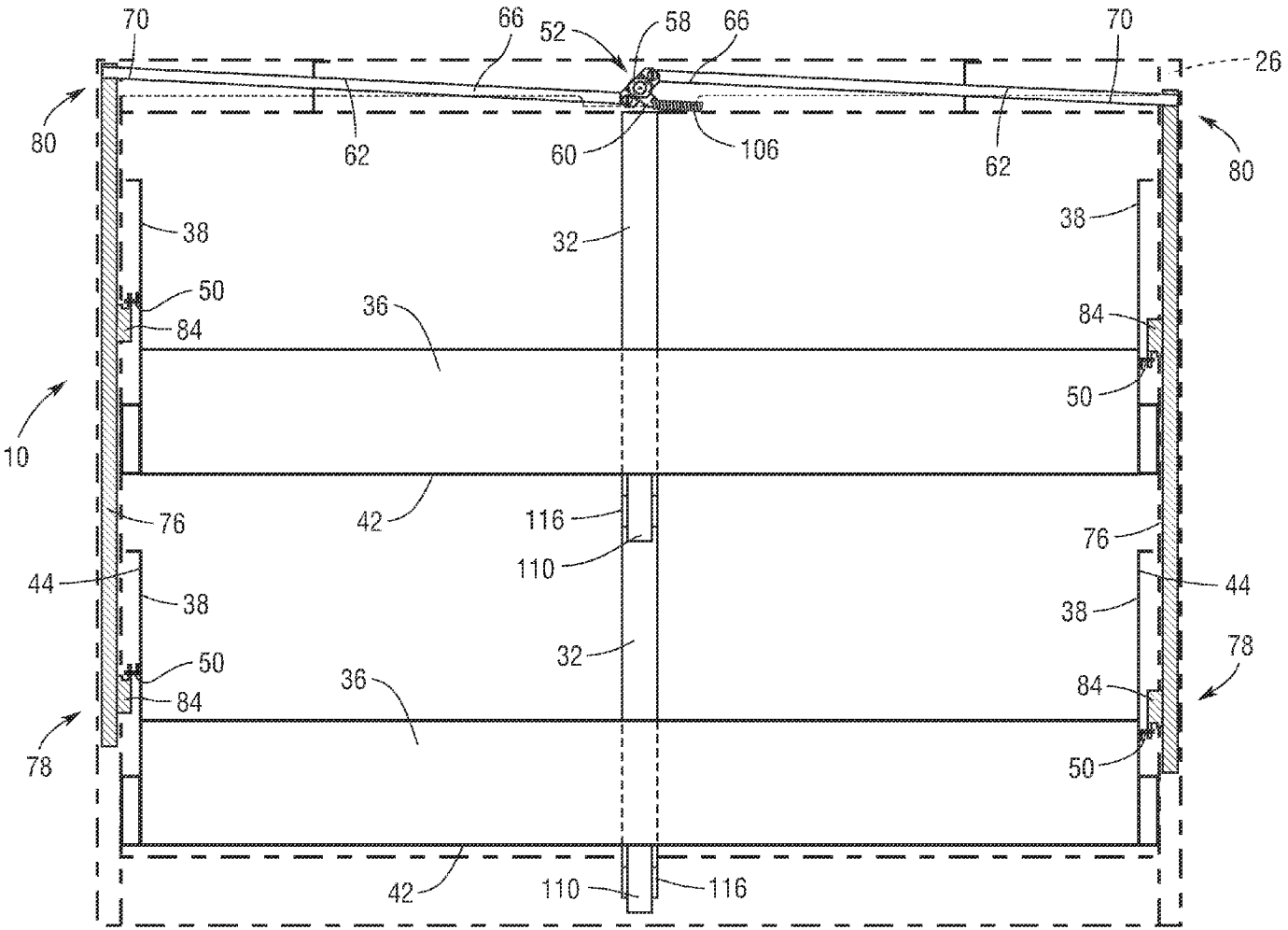
FIG. 12*b* is a front elevational view of the self-closing, self-locking security file cabinet of the present invention illustrating the disposition of the left hand and right hand lock bars and the upper and lower left hand and right hand lock catches relative to the corresponding protrusions on the file drawers when the lower and upper file drawers of the cabinet are in the closed and locked disposition.

Illustrated in FIGS. 10*a*, 10*b*, 12*a*, and 12*b* is a lock return means for automatically returning lock 58 to the locked position immediately upon key 56 being released by the user. The lock return means assures that lock 58 doesn't stay in the unlocked position when key 56 is released or lock 58 is deactivated. The lock return means of the present invention includes spring loaded lock cam 60 and a lock return spring 106 (such as a coil or extension spring) having one end connected to lock assembly 52 and a second end fixedly connected to a horizontal structural support member 108 located immediately behind upper front panel strip 26. Lock return spring 106 is in the relaxed state, as shown in FIG. 12*b*, when drawers 12 are closed and in the locked position; and when lock 58 is rotated for initiating the process of unlocking drawers 12, lock return spring 106 is stretched and under tension as shown in FIG. 12*a*. Immediately upon the user releasing lock 58 (by physically releasing his/her hold on key 56), spring 106 contracts and automatically returns lock 58 to the locked position.

As shown in FIGS. 1, 2, and 11*a* through 12*b*, security file cabinet 10 of the present invention includes a controlled rate of acceleration drawer return and closure means for returning open drawer 12 to the closed position when released by the user. The force exerted by the user in opening drawer 12 is stored in and by the drawer return and closure means and used to close drawer 12 with a controlled speed. The force exerted during closure of drawer 12 by the controlled rate of acceleration drawer return and closure means is controlled and maintained at a minimum in order to prevent damage to drawers 12 or cabinet 10 when drawer 12 closes as opposed to drawer closure under standard conditions that do not utilize a closure means. The drawer return and closure means thus includes at least one controlled rate of acceleration coil spring 110 mounted to channel 32 located at back wall 20 of cabinet 10. A bracket 112 having a pair of spaced-apart bracket members 114 is mounted to channel 32 and is positioned subjacent to underside panel 42 of drawer 12 with coil spring 110 rotatably disposed on an axle 116 with hubs 118 of axle 116 mounted to the opposed bracket members 114. There will be one coil spring 110 for each drawer 12, and thus with file cabinet 10 of the present invention will include two coil springs 110. Each coil spring 110 has a distal end 120 that is secured to underside panel 42 at rear 48 of drawer 12 so that coil spring 110 unwinds as drawer 12 is pulled open after lock 58 is unlocked; and after lock 58 has been released and returned to the locked position by the action of lock return spring 106, and the user releases his/her grip on drawer 12, coil spring 110 winds back upon axle 116 in a controlled manner. This winding actuates the retraction of drawer 12 to the fully closed and locked position within cabinet 10.

Figure 14A:
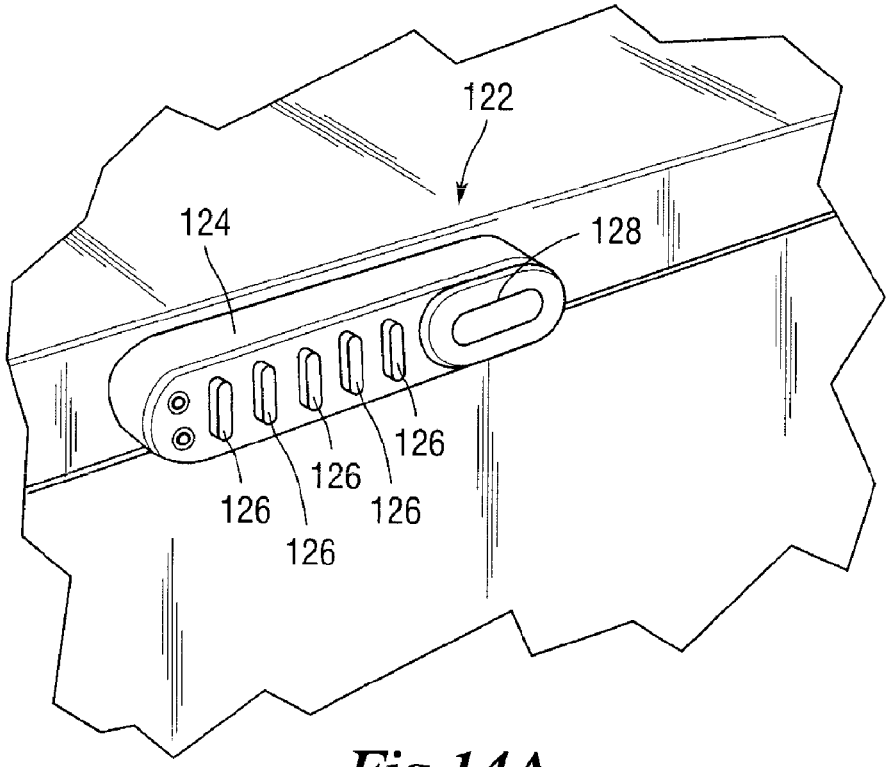
FIG. 14*a* is a partial perspective view of the self-closing, self-locking security file cabinet of the present invention illustrating an alternative key and lock assembly in the form of a no key lock assess system having a pivotal locking/unlocking member for unlocking and locking the file drawers of the security file cabinet; and, FIG. 14*b* is a partial perspective view of the self-closing, self-locking security file cabinet of the present invention illustrating the locking/unlocking member pivoted to unlock the file cabinet after the user has entered the specific code or sequence of numbers using the access code buttons thereby allowing the user to rotate the locking/unlocking member and open the file drawers.
Figure 14B:
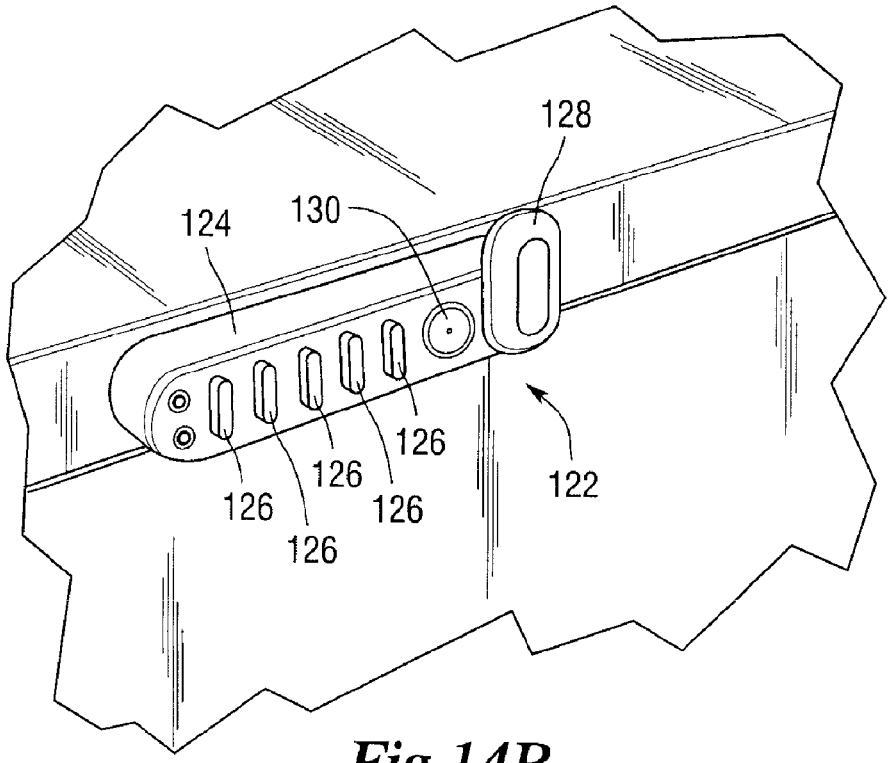

Illustrated in FIGS. 14*a* and 14*b* is a representative no key lock assembly 122 that can be used as an alternative embodiment to lock assembly 52 shown in FIGS. 4, 10*a*, 10*b*, 12*a*, and 12*b*. No key lock assembly 122 of FIGS. 14*a* and 14*b* includes a button pad lock 124 that is interconnected to intermediate link bars 62 in any conventional manner, and five oblong-shaped spaced-apart access code buttons 126 that are pressed in a predetermined sequence for entering an access code. A pivotal oblong lock and unlock member 128 interacts with a retractable and extendable lock bolt 130 to actuate intermediate link bars 62 and lock bars 76 for unlocking and locking cabinet 10. FIG. 14*a* shows no key lock assembly 122 in the locked position with pivotal oblong lock and unlock member 128 held in the locked position and FIG. 14*b* shows the no-key lock assembly in the unlocked position. Lock assembly 122 has a barrel identical to key lock 58 previously described. Lock assembly 122 fits into the same slot 54. Lock assembly 122 is positioned concentric with the pivot point of oblong member 128. After the user enters the appropriate access code by pressing access code buttons 126 in the right sequence, the lock bolt which is actuated to retract (by a solenoid or other conventional means), thereby allowing the user to rotate lock and unlock member 128 at least 90 degrees, as shown in FIG. 14*b*, to initiate the mechanical process that results in drawer(s) 12 being unlocked. Rotating oblong lock and unlock member 128 back to the horizontal position so that it initiates the process that results in the locking of drawer(s) 12.

With reference to FIGS. 1 through 12*b*, the basic operation of security file cabinet 10 will now be described. With drawers 12 in the closed and locked position as shown in FIG. 1, the user will insert key 56 into lock 58 and rotate key 56 for unlocking cabinet 10. Turning lock 58 causes lock cam 60 to engage intermediate link bars 62 to pivot and move from the position shown in FIG. 12*b* to the position shown in FIG. 12*a*. The pivotal movement of intermediate link bars 62 will be transmitted as linear motion to left and right lock bars 76 thereby causing lock bar 76 designated the left-hand lock bar to slide downward in its lock channel 72 while, at the same time, causing lock bar 76 designated the right-hand lock bar to slide upward in its lock channel 72. The slidable opposite movement of lock bars 76 (the left and right-hand lock bars) allows protrusions 50 on all drawers 12 to clear lock catches 84, and with the user maintaining his/her hold on key 56, drawers 12 can now be pulled open. Coil spring 110 attached to underside panel 42 of each drawer 12 unwinds concomitant with drawer(s) 12 being pulled open so that when drawer(s) 12 are in the full open position, coil springs 110 are unwound and disposed in the orientation shown in FIG. 11*a*.

Figure 13C:
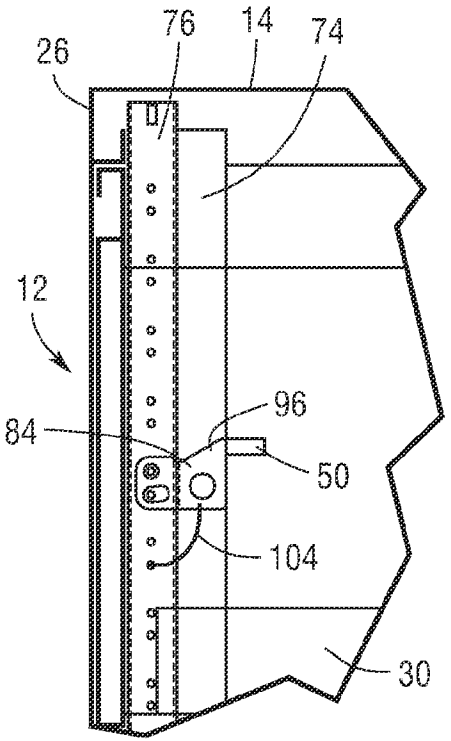
FIG. 13*c* is a partial side elevational view of the self-closing, self-locking security file cabinet of the present invention illustrating the disposition of the drawer when the drawer protrusion has completely cleared and passed by the corresponding lock catch thereby allowing the lock catch to pivot upward to its normal position thereby blocking any forward movement by the drawer protrusion and maintaining the drawer in the closed disposition.
Figure 13B:
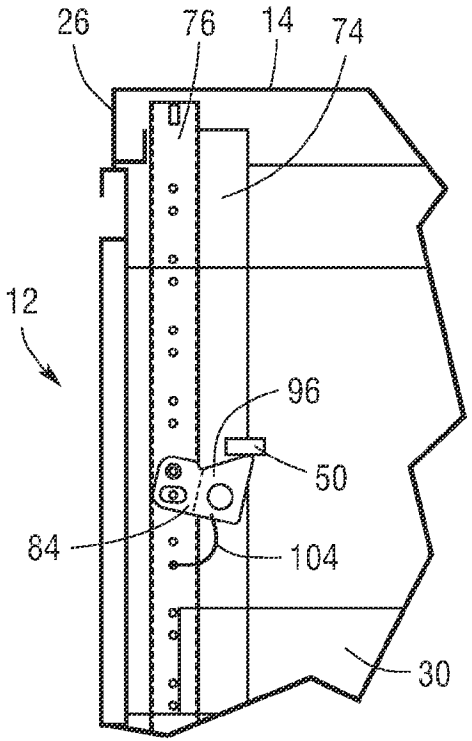
FIG. 13*b* is a partial side elevational view of the self-closing, self-locking security file cabinet of the present invention illustrating the disposition of the drawer shown in FIG. 13*a* as the drawer protrusion engages and forces the lock catch to pivot downward as part of the process of the drawer automatically returning upon release to the closed disposition.
Figure 13A:
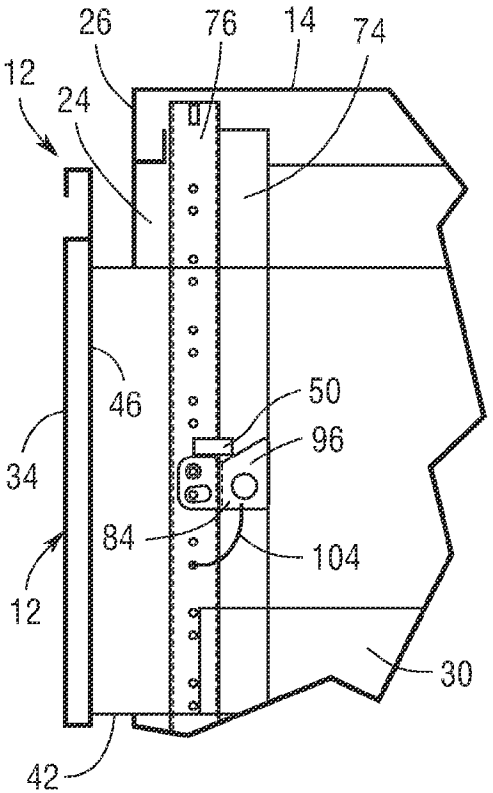
FIG. 13*a* is a partial side elevational view of the self-closing, self-locking security file cabinet of the present invention illustrating the disposition of one drawer as the drawer closes and the lock catch passes underneath and adjacent to the corresponding drawer protrusion mounted to the external surface of one sidewall of the drawer.

The user then releases his/her hold on key 56, and immediately upon releasing key 56 lock return spring 106 automatically returns lock 58 to the locked position by its spring force action, and this transition from the unlocked to the locked state is shown in FIGS. 12*a* and 12*b* as lock return spring 106 goes from the stretched to the relaxed state corresponding to the locked and then the unlocked positions. The user can then deactivate lock 58, i.e., remove key 56 from lock 58 or remove the access card for a no key lock assembly, and, at the same time, remove the desired items, files, documents, etc., from drawers 12. After the documents are retrieved, the user can then release his/her grip on drawers 12. As the grip on drawers 12 is released, drawers 12 commence retraction back into cabinet 10 by the force of constant rate coil spring 110 as coil spring 110 winds upon axle 116 of bracket 112. With reference to FIGS. 13*a*-13*c*, as a substantial portion of drawers 12 are retracted into cabinet 10 protrusions 50 on drawers 12 engage lock catches 84 pivotally mounted on lock bars 76 denoted the left and right-hand lock bars. Concomitant with the continued retraction of drawers 12 all protrusions 50 simultaneously contact beveled sides 96 of the corresponding lock catches 84 forcing lock catches 84 to momentarily pivot out of the way to permit the passage of protrusions 50 and the continued retraction of drawers 12. This interaction between protrusions 50 and lock catches 84 is shown in FIGS. 13*a* and 13*b*. It should be noted that lock catch 84 being pivoted out of the way is one of lock catches 84 mounted to the left-hand lock bar 76 as also shown in FIGS. 12*a* and 12*b*. Lock catches 84 mounted to right-hand lock bar 76 are located above protrusions 50 mounted to drawers 12, so that protrusions 50 engage and pivot these lock catches 84 upward and out of the way to allow drawers 12 to continue their retraction. Also, the winding of coil springs 110 to retract drawers 12 at a controlled rate of acceleration continues simultaneous with the contact of protrusions 50 with the corresponding lock catches 84. As protrusions 50 clear lock catches 84 drawers 12 continue their smooth, continuous, uninterrupted rearward travel back into cabinet 10, and lock catch springs 104 instantly return lock catches 84 to the locked position as shown in FIG. 13*c*. When lock catches 84 are in the position shown in FIG. 13*c* it is not possible to pull drawers 12 back open as lock catches 84 block any forward movement of protrusions 50. Drawer(s) 12 are now returned to their fully closed and locked position and coil springs 110 are fully wound back upon axles 116 and all lock catches 84 are disposed to the locked position.

A preferred embodiment of the invention has been disclosed herein, and it should be understood that numerous modifications, alterations, and variations are possible and practicable by those skilled in the art while still remaining within the spirit and scope of the invention as set forth in the appended claims.

I claim:

1. A self-closing and self-locking security file cabinet comprising:

a back wall, a top wall, a pair of opposed sidewalls with each sidewall defining an inside surface, a bottom panel and further defining a front area and a rear area;

a plurality of sliding supports with at least one sliding support mounted to the inside surface of each sidewall;

a channel centrally mounted to the back wall and extending from the bottom panel to the top wall;

a lock assembly mounted adjacent to the front area and including a lock selectively movable between a locked and an unlocked position;

a pair of intermediate link bars interconnected to the lock assembly with each intermediate link bar extending to one of the sidewalls;

a pair of lock bars with each lock bar mounted to the inside surface of the respective sidewalls and the intermediate link bars connected to the lock bars for actuating the selective slidable linear up and down movement of the lock bars;

a plurality of lock catches pivotally mounted to the lock bars with at least one lock catch mounted to each lock bar;

at least one drawer mounted on the sliding supports so that the drawer can be selectively opened and closed;

the drawer including a drawer front panel, an underside panel and a pair of opposed side panels with each side panel having an exterior side surface;

a pair of protrusions with each protrusion mounted to the exterior side surface of each side panel and engaging the respective lock catches during the closing of the drawer;

a coil spring mounted to the channel and having a distal end attached to the drawer for retracting back into the security file cabinet at a controlled rate of acceleration when the user releases the drawer;

a lock return means for returning the lock to the locked position immediately upon the release of the lock by the user; and, rotation of the lock being transmitted through the intermediate link bars for slidably linearly moving the lock bars and pivoting the lock catches so that the drawer can be opened and release of the user's grip on the drawer allows the coil spring to wind and retract the drawer concomitant with the protrusions contacting and pivoting the lock catches out of the way so that the protrusions can clear the lock catches in order for the retraction of the drawer to continue with the lock catches being pivoted back to the locked position upon the drawer being fully retracted within the security file cabinet.

2. The self-closing and self-locking security file cabinet of claim 1 further comprising a plurality of lock catch springs with the lock catch springs interconnected to the respective lock bars and lock catches thereby spring loading the lock catches for returning the lock catches to the locked position after the protrusions have cleared the lock catches in the process of drawer retraction and closure.

3. The self-closing and self-locking security file cabinet of claim 2 wherein the lock return means includes a lock return spring that automatically returns the lock to the locked position immediately upon the release of the lock by the user.

4. The self-closing and self-locking security file cabinet of claim 3 wherein one of the pair of lock bars slides upward toward the top wall and the other of the pair of lock bars slides downward toward the bottom panel upon rotation of the lock to the unlocked position for opening the drawer.

5. The self-closing and self-locking security file cabinet of claim 4 wherein the lock catch pivotally mounted to one of the lock bars passes below the corresponding protrusion and the lock catch pivotally mounted to the other lock bar passes above the corresponding protrusion during the retraction and closure of the drawer.

6. A self-closing and self-locking security file cabinet, comprising:

a back wall, a top wall, a pair of opposed sidewalls with each sidewall defining an inside surface, a bottom panel, and a front, a plurality of sliding supports with at least one sliding support mounted to the inside surface of each sidewall;, a lock assembly mounted adjacent to the front and including a lock selectively rotatable between a locked and an unlocked position;

a pair of intermediate link bars interconnected to the lock assembly with one intermediate link bar extending to one sidewall and the other intermediate link bar extending to the other sidewall;

a pair of lock bars with each lock bar mounted to the inside surface of the respective sidewalls and the intermediate link bars connected to the lock bars for actuating the selective slidable linear up and down movement of the lock bars;

a plurality of lock catches with at least one lock catch being pivotally mounted to each lock bar;

at least one drawer mounted to the sliding supports so that the drawer can be selectively opened and closed;

the drawer including a drawer front panel, an underside panel and a pair of opposed side panels with each side panel having an exterior side surface;

at least one pair of protrusions with one protrusion mounted to the respective exterior side surface of each side panel for interacting with the corresponding lock catches to facilitate the opening and closing of the drawer;

a lock return means for returning the lock to the locked position immediately upon the release of the lock by the user;

rotation of the lock being transmitted through the intermediate link bars to the lock bars for slidably linearly moving the lock bars and pivoting the lock catches so that the drawer can be opened and release of the user's grip on the drawer after the drawer has been opened allows the lock return means to return the lock to the locked position and commences retraction of the drawer whereupon the protrusions contact and pivot the lock catches so that the protrusions clear the lock catches in order for the drawer retraction to continue with the lock catches pivoting back to the locked position with the retraction of the drawer continuing until the drawer is returned within the security file cabinet;

a channel mounted to the back wall and extending from the bottom panel to the top wall; and, a constant force return spring rotatably mounted to the channel and having a distal end attached to the drawer so that when the drawer is released by the user the winding of the constant force return spring facilitates the retraction of the drawer within the security file cabinet at a controlled rate of acceleration.

7. The self-closing and self-locking security file cabinet of claim 6 further comprising a plurality of lock catch springs with each lock catch interconnected to the respective lock bar and lock catch thereby spring loading the respective lock catch so that each lock catch immediately returns to the locked position after that corresponding protrusion has cleared the lock catch during the opening of the drawer and the retraction and closure of the drawer.

8. The self-closing and self-locking security file cabinet of claim 7 wherein the lock return means includes a lock return spring for automatically returning the lock to the locked position immediately upon the release of the lock by the user.

9. The self-closing and self-locking security file cabinet of claim 8 wherein one of the pair of lock bars slides upward toward the top wall and the other lock bar slides downward toward the bottom panel upon rotation of the lock to the unlocked position for initiating the opening of the drawer.

10. The self-closing and self-locking security file cabinet of claim 9 wherein one of the pair of lock catches pivotally mounted to one lock bar passes below the corresponding protrusion while the other lock catch pivotally mounted to the other lock bar passes above the corresponding protrusion during the retraction and closure of the drawer.

11. A self-closing and self-locking security file cabinet, comprising:

a back wall, a top wall, a pair of opposed sidewalls with each sidewall defining an inside surface, and a bottom panel;

a lock assembly including a lock that is selectively rotatable between a locked position and an unlocked position;

a plurality of sliding supports with at least one sliding support mounted to the inside surface of each sidewall;

at least one drawer mounted to the sliding supports so that the drawer can be selectively opened from the security file cabinet and selectively closed therein;

said drawer having a bottom panel; and, a controlled rate of acceleration return spring mounted to the back wall and having a distal end secured to the bottom panel so that the return spring unwinds concomitant with the opening of the drawer and winds concomitant with the release of the drawer by the user whereupon release of the drawer by the user allows the controlled rate of acceleration to retract the drawer within the security file cabinet with a controlled rate of acceleration until the drawer is fully returned within the security file cabinet;

a pair of intermediate link bars interconnected to the lock assembly with one intermediate link bar extending to one sidewall and the other intermediate link bar extending to the other sidewall;

a pair of lock bars with each lock bar mounted to the inside surface of the sidewalls and each lock bar being interconnected to each intermediate link bar so that the movement of the intermediate link bars actuates the slidable linear up and down movement of the lock bars;

a plurality of lock catches with at least one lock catch being pivotally mounted to each lock bar;

at least one pair of protrusions mounted to the drawers for interacting with the lock catches to facilitate the retraction and locking of the drawer within the security file cabinet; and at least one pair of lock catch springs with one lock catch spring interconnected to one lock catch and lock bar and the other lock catch spring interconnected to the other lock catch and lock bar for allowing the protrusions to freely move past the lock catches during the opening of the drawer and to allow the lock catches to pivot out of the way to facilitate the clearance of the protrusions during the retraction of the drawer.

12. The self-closing and self-locking security file cabinet of claim 11 further comprising a lock return means for automatically returning the lock to the locked position upon the release of the lock by the user.

* * * * *